US006892494B2

(12) United States Patent
Malek

(10) Patent No.: US 6,892,494 B2
(45) Date of Patent: May 17, 2005

(54) LOCK SHOE SYSTEM

(75) Inventor: Neeman Malek, Lorraine (CA)

(73) Assignee: Pomeroy, Incorporated, Dubuque, IA (US)

( * ) Notice: Subject to any disclaimer, the term of this patent is extended or adjusted under 35 U.S.C. 154(b) by 105 days.

(21) Appl. No.: 10/629,423

(22) Filed: Jul. 29, 2003

(65) Prior Publication Data

US 2004/0065016 A1 Apr. 8, 2004

Related U.S. Application Data

(60) Provisional application No. 60/416,378, filed on Oct. 5, 2002.

(51) Int. Cl.[7] ..... E05D 15/22

(52) U.S. Cl. ..... 49/181; 49/447

(58) Field of Search ..... 49/176, 181, 445, 49/446, 447; 16/197, 200, DIG. 16

(56) References Cited

U.S. PATENT DOCUMENTS

| | | | | |
|---|---|---|---|---|
| 2,796,630 A | | 6/1957 | Haas | |
| 3,197,819 A | | 8/1965 | Trout | |
| 3,280,511 A | | 10/1966 | Johnson | |
| 4,799,333 A | | 1/1989 | Westfall et al. | |
| 4,885,871 A | | 12/1989 | Westfall et al. | |
| 5,027,557 A | * | 7/1991 | May | 49/181 |
| 5,189,838 A | | 3/1993 | Westfall | |
| 5,231,795 A | | 8/1993 | Westfall | |
| 5,542,212 A | * | 8/1996 | Erickson et al. | 49/181 |
| 5,572,828 A | * | 11/1996 | Westfall | 49/181 |
| 6,041,475 A | | 3/2000 | Nidelkoff | |

FOREIGN PATENT DOCUMENTS

| | | |
|---|---|---|
| CA | 2 229 252 | 4/2002 |

* cited by examiner

*Primary Examiner*—Jerry Redman
(74) *Attorney, Agent, or Firm*—Robert A. Seemann

(57) ABSTRACT

A window balance shoe includes a downward depending pivoted arm that locks the height of the shoe on the jamb by catching in an opening in the jamb wall, or rotates out of the opening in the jamb wall and extends in a curved arm having a radius from the arm's pivot, through a hole that is through a horizontal platform on the shoe and through a hole in an arm supported by the platform, that pivots on and supports a bracket that is attached to the sash.

7 Claims, 10 Drawing Sheets

LOCK SHOE SYSTEM

This application claims the benefit of U.S. Provisional Application No. 60/416,378, filed Oct. 5 2002.

BACKGROUND OF THE INVENTION

1. Field of the Invention

The invention pertains to counterbalanced movable or removable closures, more particularly to an interlocking jamb mounted locking shoe and sash mounted locking pivoted support arm system.

2. Description of the Prior Art

U.S. Pat. No. 2,796,630 patented Jun. 25, 1957 by G. B. Haas describes a self-locking sash balance in which a plunger from the sash rests upon a first radial side of a tripping lever that is pivotally mounted on a shoe that is biased upward by a balance spring. The second radial side of the tripping lever engages a pivoted detent so that when the plunger applies weight of the sash upon the first radial side, the second radial side presses upward on one side of the detent, rotating the other side of the detent out of biting engagement with a vertical side of the track in which the shoe rides.

U.S. Pat. No. 4,799,333 patented Jan. 24, 1989 by Westfall et al. describes a lock shoe system for a take-out window in which a horizontal pin from the sash pushes back a biter knife lever pivotally mounted on the balance shoe so that the knife disengages from the vertical track in which the shoe slides.

U.S. Pat. No. 5,189,838 patented Mar. 2, 1993 by N. R. Westfall describes a tilt sash lock shoe system in which an elongated sash pin can be lowered into or lifted vertically from a slot formed by confronting first and second vertical surfaces. The first vertical surface is a wall of the shoe. The second vertical surface is on a pivoted element that has a biting edge on one side of the pivoted element, that is rotated against the window track by upward force of the system's counter balance spring on the other side of the pivoted element. When the sash is tilted from the vertical with the pin in the shoe, or when the sash is removed from the window, the biting edge presses into the track. When the sash is vertical with an oblong end of the pin in the shoe, the oblong end forces the first and second vertical surfaces apart which rotates the pivoted element so that the biting edge is moved away from the track.

U.S. Pat. No. 5,231,795, patented Aug. 3, 1993 by N. R. Westfall describes a shoe designed to be supported by a spring counterbalance system, that is mounted on a jamb for vertical movement on the jamb. A lower outward corner of a sash rests on an inward extending platform extension of the shoe. A horizontally sliding bolt in the shoe is moved inward horizontally into a recess in the lower corner of the sash. Movement of the bolt is by a vertical pin eccentrically mounted on the top of a cylinder that rotates on a vertical axis. The cylinder is turned by a hex keyed hand tool from below the cylinder. In order to remove the sash from the window, the sash is moved down until an upward turned outer end of the bolt is below a downward depending lance that extends outward from the jamb in the direction of the sash. The bolt is slid outward so that when the sash is lifted, the shoe moves up until the outer end of the bolt catches under the lance. The sash, now free of the bolt, is then slid laterally off the platform for removal from the window frame.

U.S. Pat. No. 6,041,475 patented Mar. 28, 2000 by M. J. Nidelkoff for a locking counterbalance shoe for tiltably removable sash windows describes a balance shoe in which a first element that is supported by the balance spring contains a second pivoted locking element having a serrated edge that grips the jamb track under the urging of an actuator spring between the first and second elements when there is no sash in the window frame. The second element unlocks from the jamb track when the flat sash pin of a vertical sash rests upon the second element, compressing the actuator spring. When the sash is rotated from vertical, the flat sash pin turns the second element to the locking position wherein the serrated edge grips the jamb track.

SUMMARY OF THE INVENTION

It is one object of the invention to provide a lock shoe system that locks the shoe to the jamb against upward movement of the shoe.

It is another object of the invention that the lock shoe system locks an arm, pivotally mounted on the sash, to the shoe.

Other objects and advantages will become apparent to one reading the ensuing description of the invention.

A lock shoe system for a window that includes a vertical jamb and a sash mounted in the window for movement up and down alongside the jamb, includes a balance shoe mounted on the jamb for vertical movement on the jamb, a platform on the balance shoe configured for vertical support of an item on the platform when an item is on the platform, and a bracket fixedly mounted on the sash. A first arm mounted on the bracket for rotating about a first axis is configured for transferring lift from a first end of the arm to the bracket, the first end of the first arm being on the platform. A second arm is mounted on the balance shoe for rotating about a second axis. A portion of the second arm spaced from the second axis includes a second end configured for hooking to the jamb at at least one height along the vertical height of the jamb when the second arm is at a first rotary position of the second arm, the portion comprising a third end configured for extending through a first opening in the platform and through a second opening in the first arm when the second arm is at a second rotary position of the second arm. The second arm includes means on the second end for locking the third end in the second opening. The second axis is preferably parallel to the first axis.

U.S. Provisional Application Ser. No. 60/416,378, filed Oct. 5, 2002 is hereby incorporated herein in its entirety by reference.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
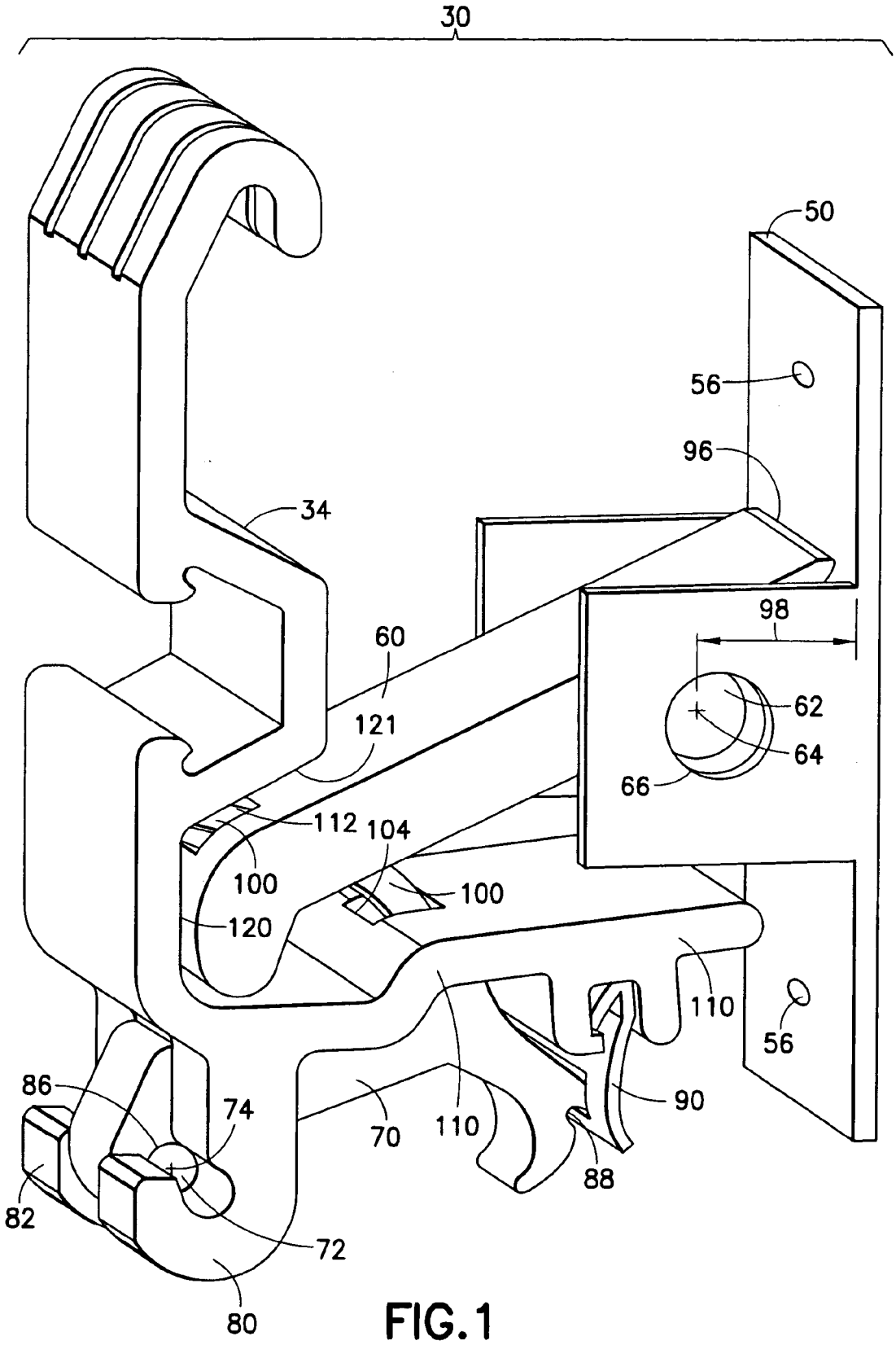
FIG. 1 is a right side perspective view of a lock shoe system according to the invention showing the sash support arm on the shoe saddle, locked to the shoe.
Figure 2:
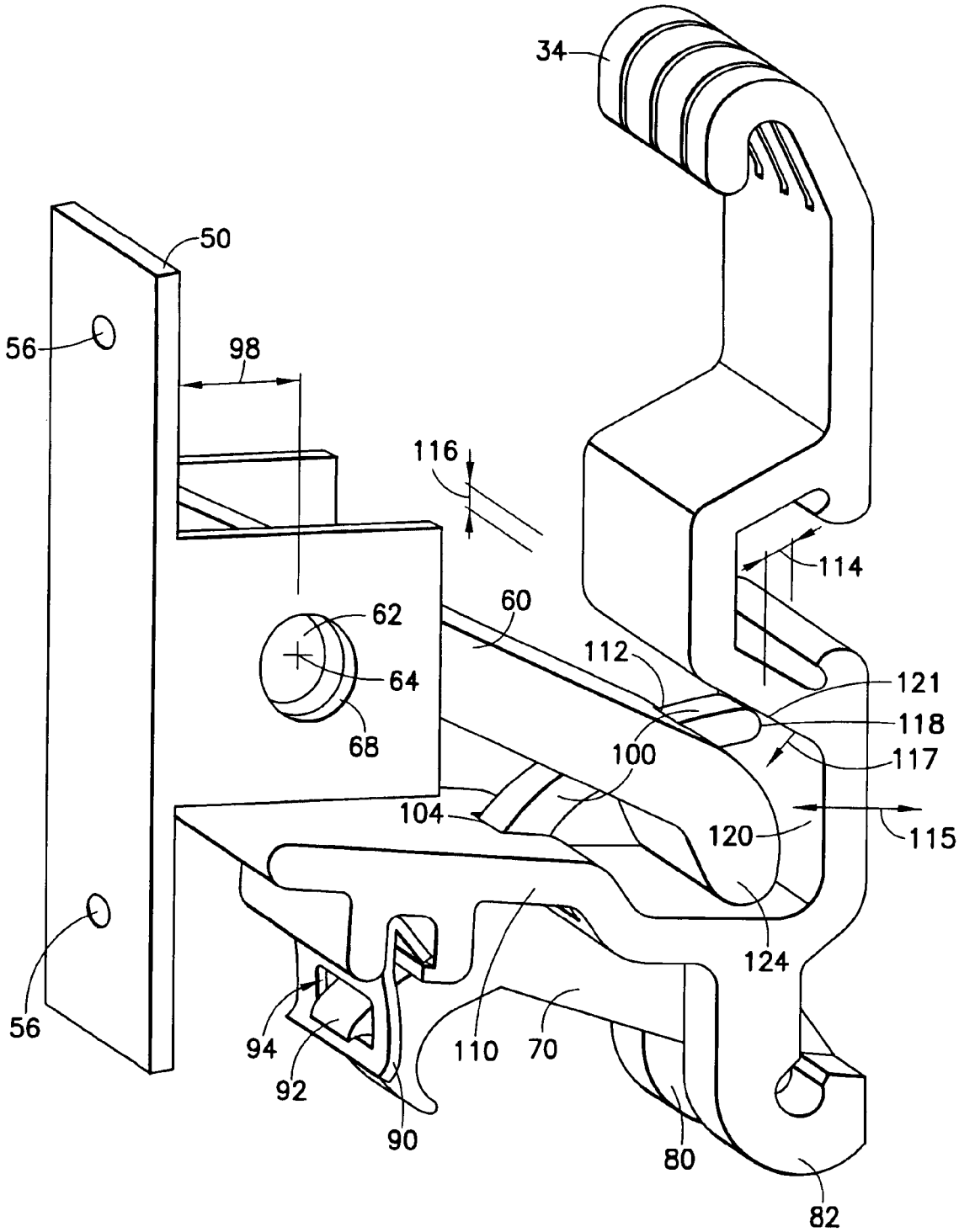
FIG. 2 is a left side perspective view of the assembly of FIG. 1.
Figure 3:
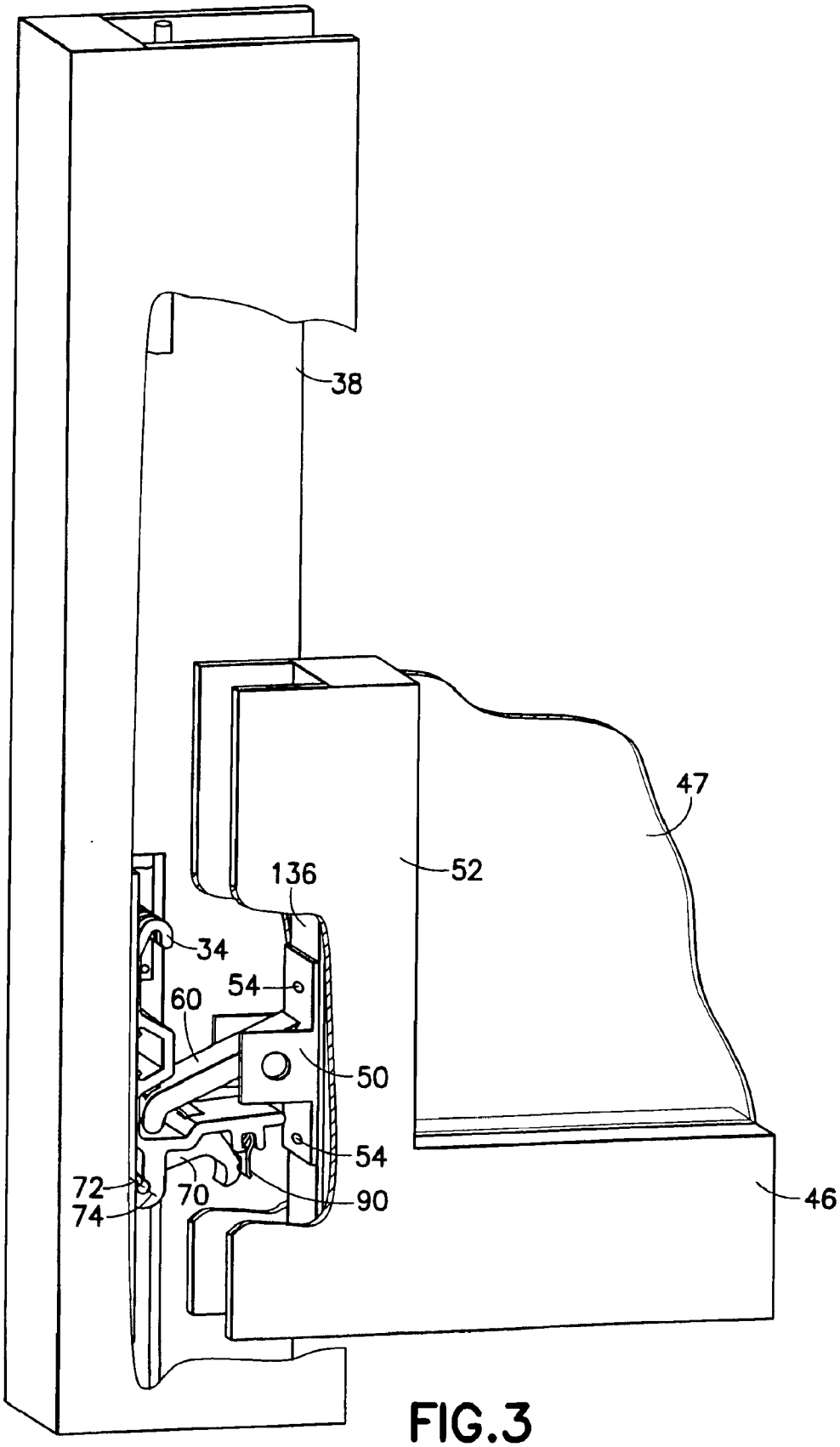
FIG. 3 is a right side perspective view from adjacent to the front of the system showing the system locked as in FIG. 1, mounted on a jamb and sash of a window.
Figure 4:
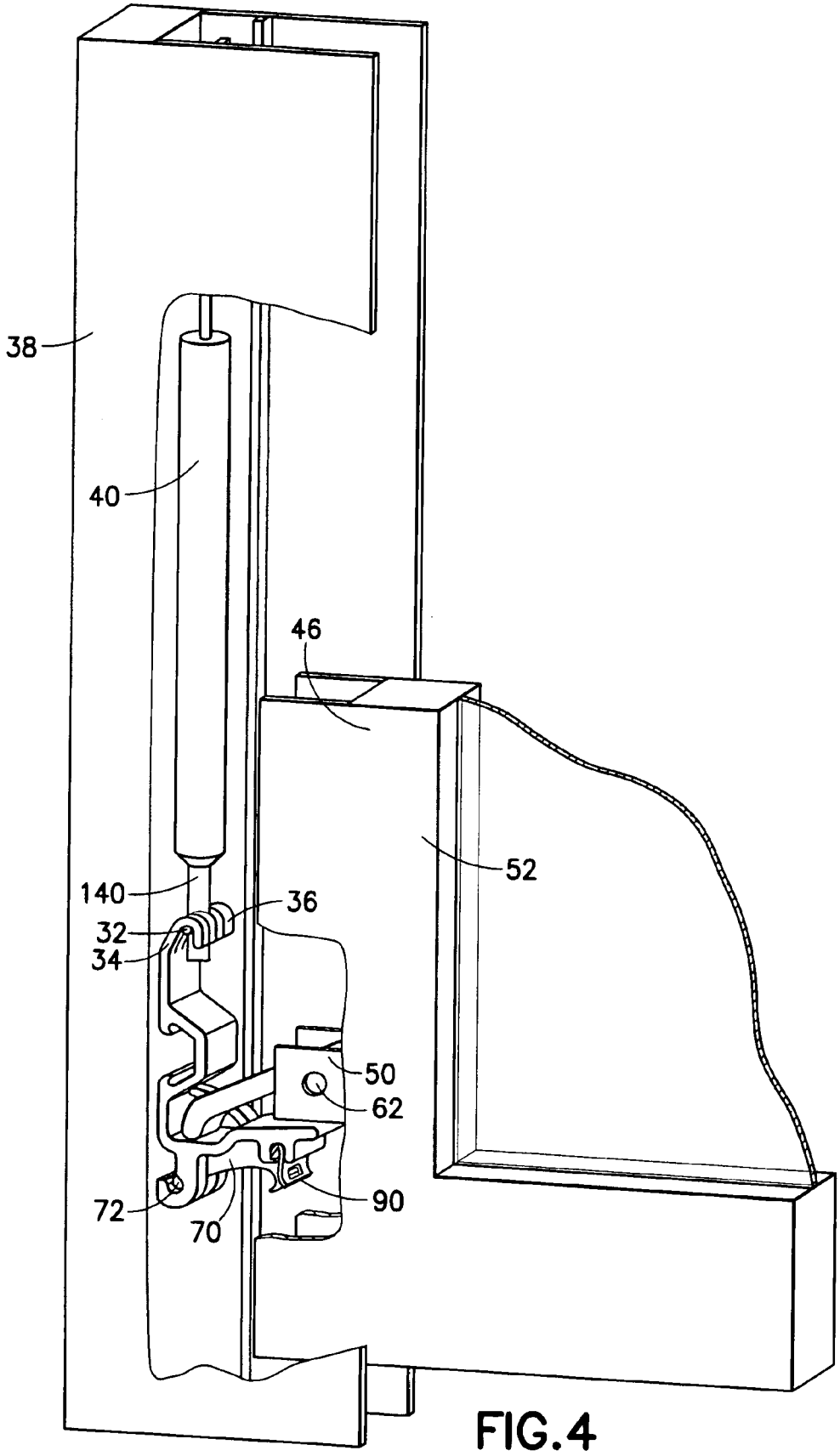
FIG. 4 is a right side perspective view from adjacent to the back of the system showing the locked, mounted system of FIG. 3. In this view, a spring balance is visible.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to FIGS. 1–4, and 9–13, shoe 34 of assembly 30 is slidingly mounted on jamb 38.

The shoe is supported vertically by spring balance 40 by way of cross pin 32 in downward open U shaped hooks 36.

Shoe 34 bears part of the weight of sash 46 which travels up and down between two jambs of a window. It is expected that another assembly according to the invention would be mounted on an opposite side of the sash and connected to the jamb adjacent to that side of the sash, also bearing part of the weight of the sash. For the purpose of description of the invention only one assembly on one side of the sash is shown and described. It should be understood that the other assembly preferably would be a duplicate of the one herein described.

The present invention will safely support and lock heavy steel and glass sashes such as those found in factories and lofts, as well as lighter wood or plastic sashes.

Bracket 50 is mounted on sash 46, screwed into stile 52 by screws 54 through mounting holes 56.

Sash support arm 60 rotates on pin 62 on axis 64 in pivot holes 66 and 68.

Shoe arm 70 rotates on pin 72 on axis 74. Pin 72 passes through upward open C-shaped bearings 80, 82 in shoe 34, and downward open C-shaped bearing 86 in shoe arm 70.

Shoe arm 70 is latched by notch 88 and protrusion 92 of arm 70 in spring clip 90 opening 94.

Clip 90 is preferably made of steel.

Curved hook 100 of shoe arm 70 extends through opening 104 in platform 110 of the shoe, and into and preferably through opening 112 in arm 60 of bracket 50. The curve of hook 100 is such that the curve prevents arm 60 from moving axially parallel to axis 64, laterally normal to axis 64, and upward or downward from platform 110. This prevents bracket 50 and the portion of the sash to which bracket 50 is attached from moving outward from the window axially, away from the jamb normal to axis 64, downward past the platform, or upward past the platform.

End 96 of arm 60 extends further from axis 64 than distance 98 of the shortest radius of axis 64 to the surface of bracket 50 so that arm 60 is prevented from rotating up to horizontal by impingement of end 96 against the bracket above the horizontal level of axis 64, so that lift expressed on end 124 by platform 110 is transferred to axis 64 by arm 60 when arm 60 is prevented from rotation by impingement of end 96 against the bracket. It should be understood that this may comprise a protrusion of the surface of the bracket that prevents rotation of arm 60 so that lift expressed on end 124 by platform 110 is transferred to axis 64 by arm 60 when arm 60 is prevented from rotation by impingement of end 96 against the protrusion.

Preferably the top 106 of arm 60 at end 96 extends farther from axis 64 than the bottom of the arm.

Sash 46 containing glass 47, locked to shoe 34 by this configuration moves up and down with the shoe.

Figure 5:
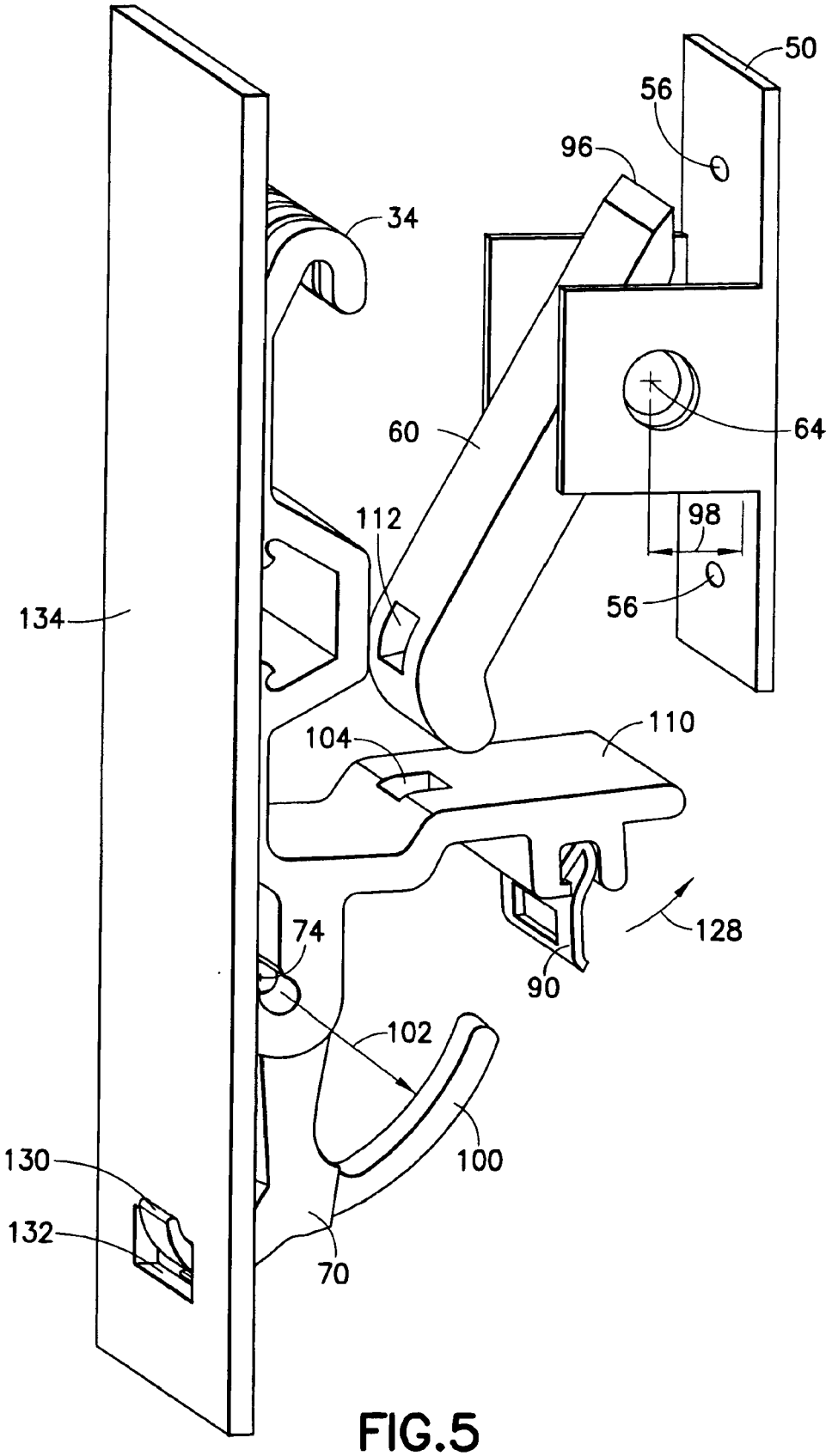
FIG. 5. is a right side perspective view of the lock system of FIG. 1 showing the shoe locked to the jamb against upward movement of the shoe, and the sash support arm disconnected from the shoe.
Figure 6:
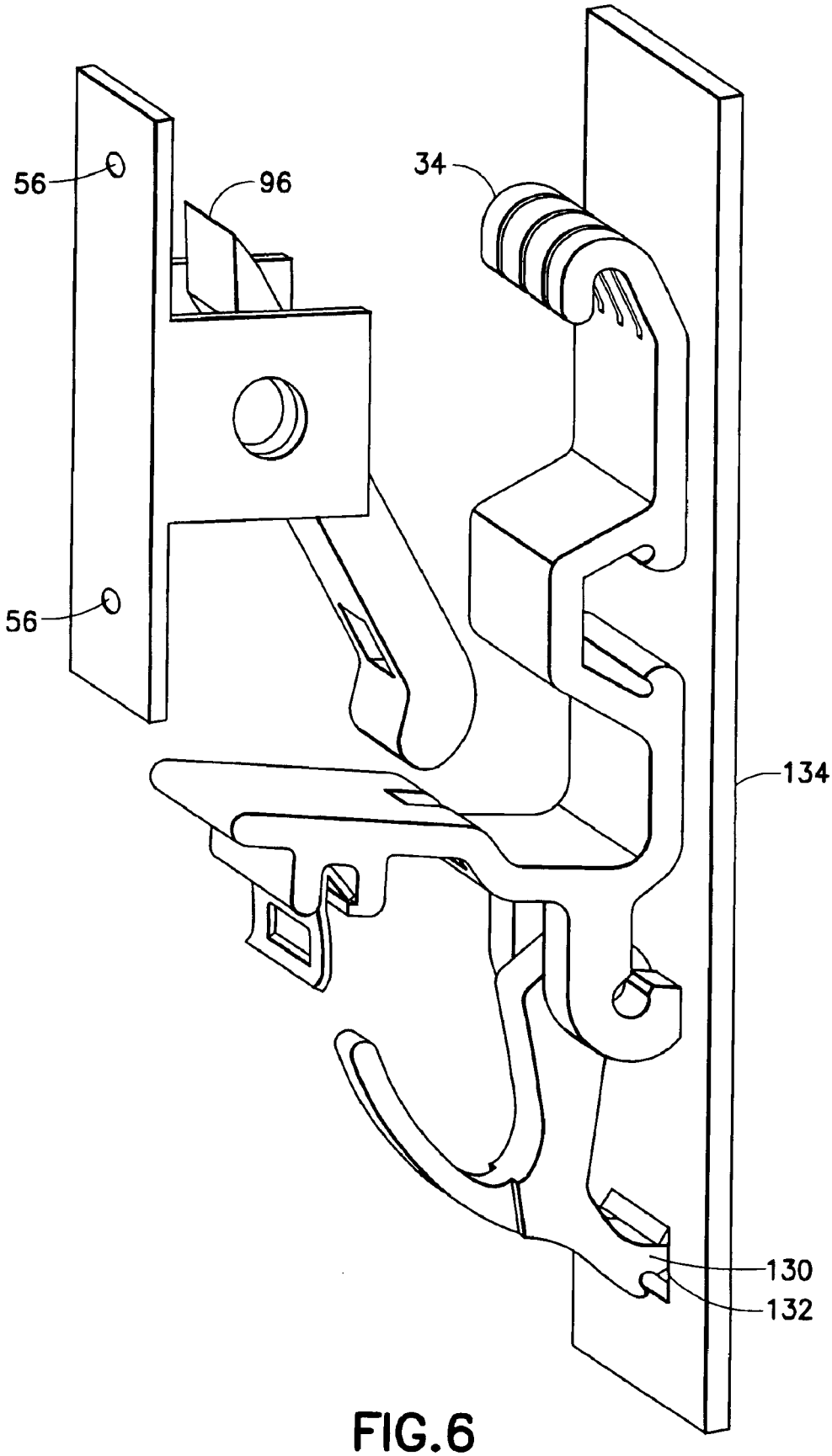
FIG. 6 is a left side perspective view of the assembly of FIG. 5.
Figure 7:
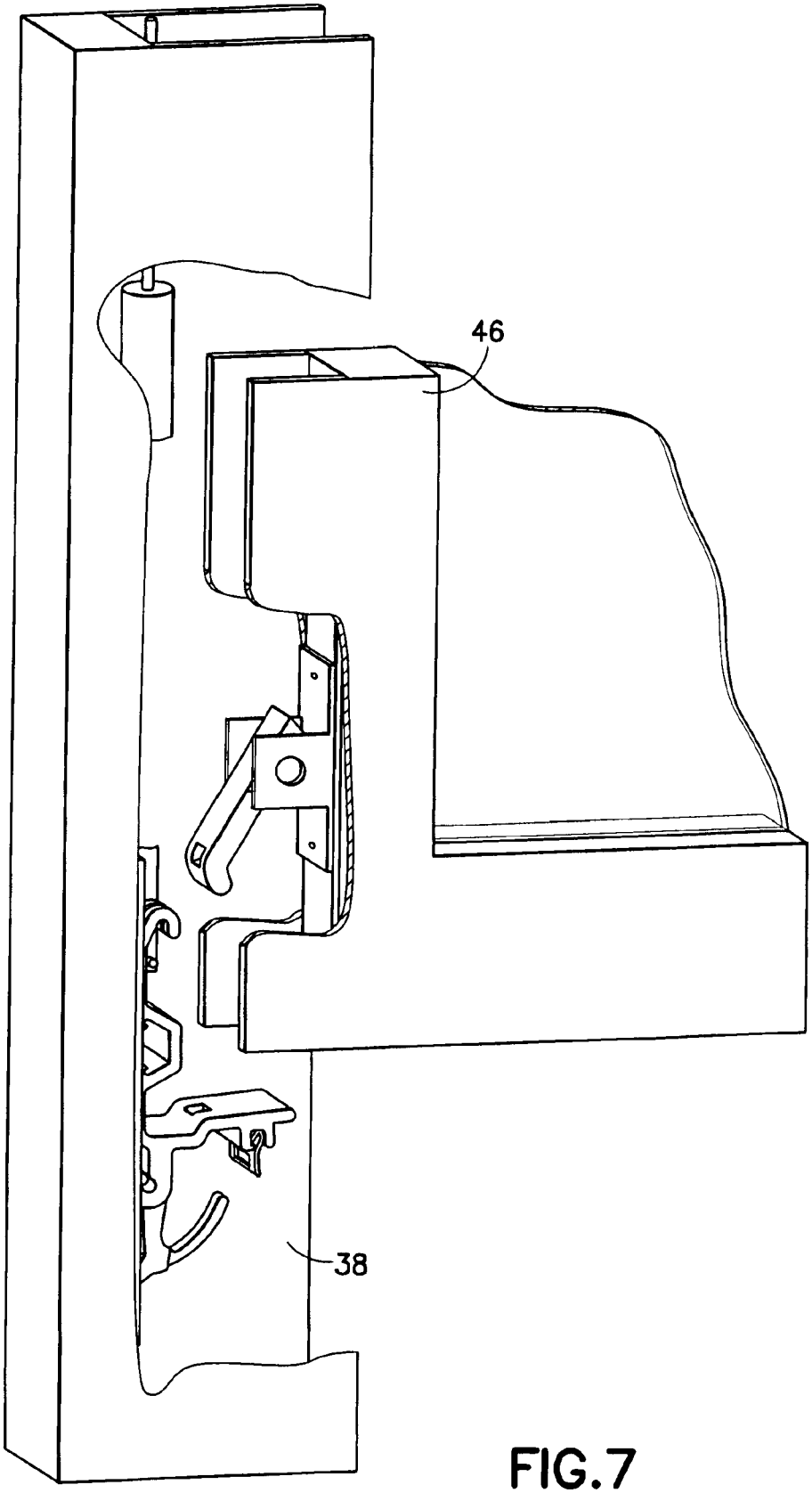
FIG. 7 is a is a right side perspective view from adjacent to the front of the system showing the shoe mounted on the jamb, locked to the jamb against upward movement, and the sash support arm and bracket disconnected from the shoe, mounted on a sash that is raised above the saddle of the shoe.
Figure 8:
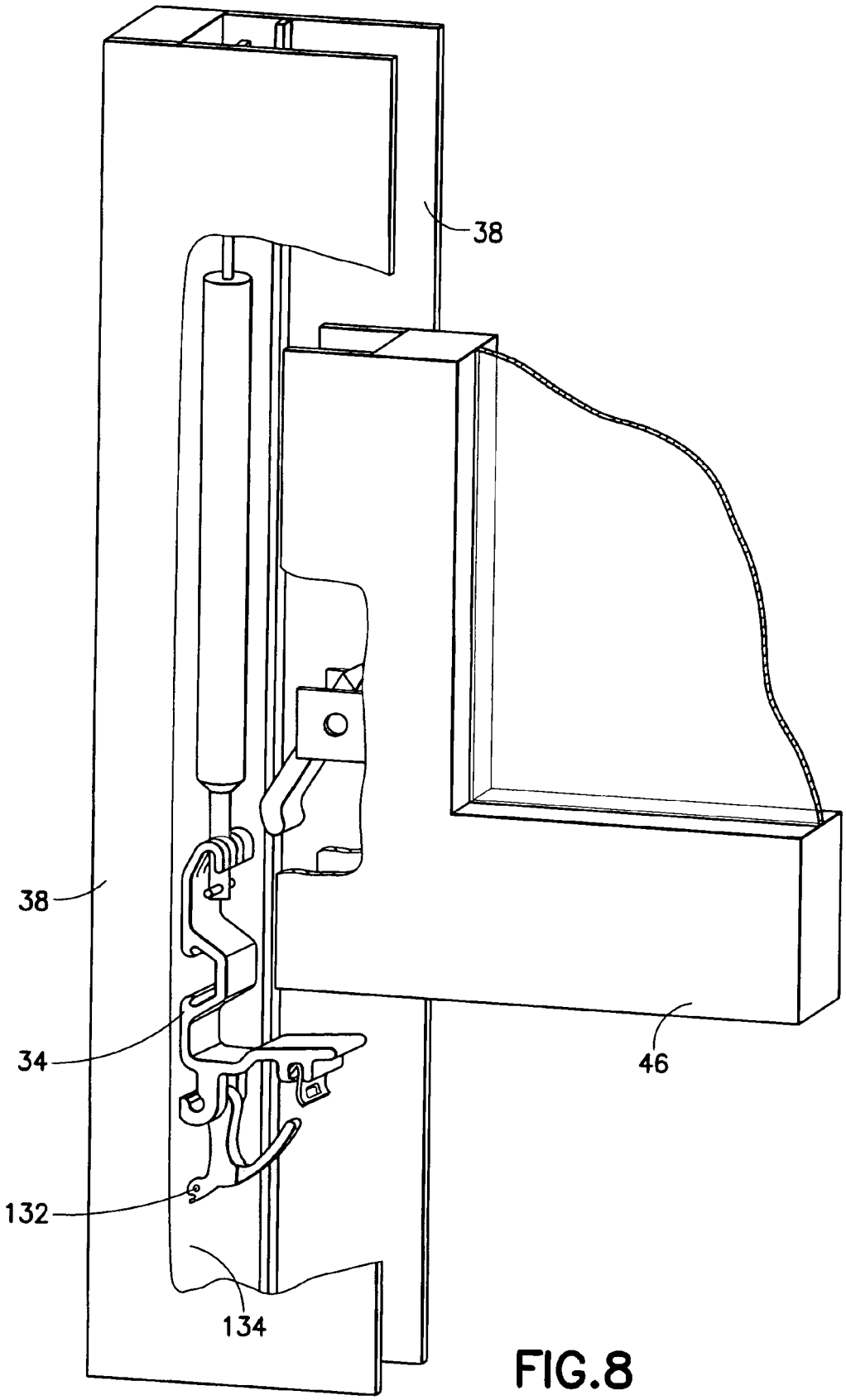
FIG. 8 is a right side perspective view from adjacent to the back of the system of FIG. 7.
Figure 9:
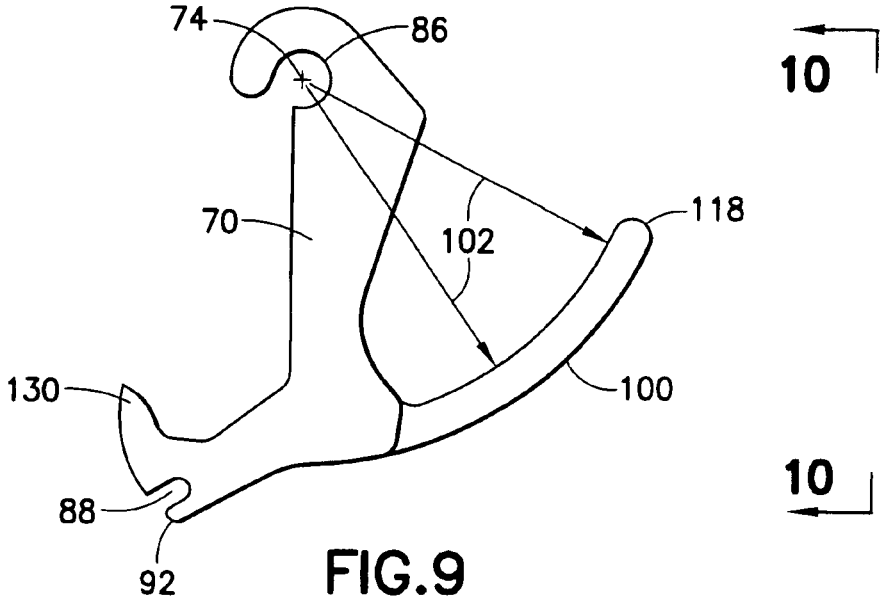
FIG. 9 is a right side view of the shoe arm.
Figure 10:
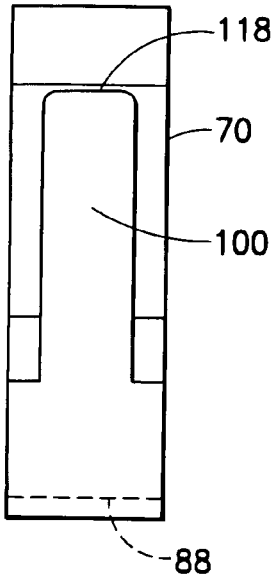
FIG. 10 is a rear view of the shoe arm of FIG. 9 taken at 10—10.
Figure 11:
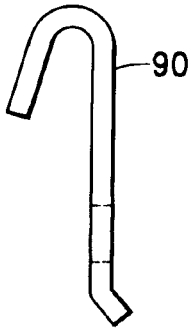
FIG. 11 is a right side view of the spring clip receiver for the shoe arm.
Figure 12:
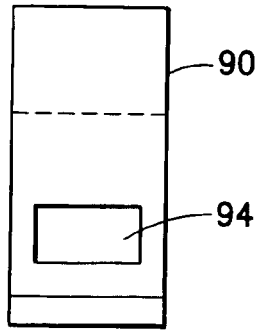
FIG. 12 is a front view of the spring clip receiver of FIG. 11.
Figure 13:
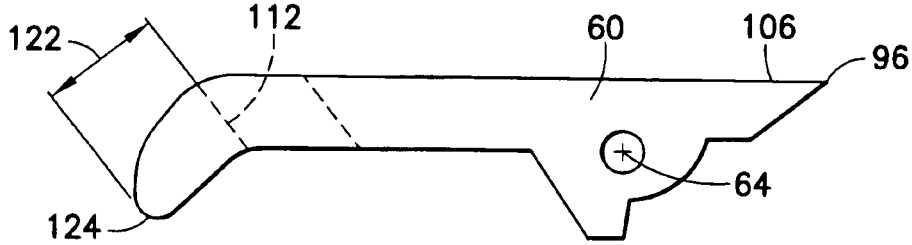
FIG. 13 is a right side view of the sash support arm.

Preferably the curve of hook 100 is on a radius 102 taken from axis 74, that is, a portion of the circumference of a circle about axis 74, shown in FIG. 5.

Spaces 114, 116 between end 118 of curved hook 100 and the horizontally 115 and downward 117 facing adjacent surfaces 120 and 121 of the shoe are smaller than the thickness 122 of arm 60 from opening 112 to end 124 that extends into the shoe.

Preferably the distance between end 118 of hook 100 and the closest surface of the shoe when hook 100 is in opening 112 and shoe arm 70 is latched in clip 90 is smaller than the thickness 122 of arm 60 such that arm 60 cannot slip past end 118 between end 118 and the closest surface of the shoe to end 118.

Referring to FIGS. 5–13, bracket 50 is screwed into the side of the sash at about the lowest part of the sash with arm 60 hanging down, or vertical, from axis 64. Shoe arm 70 is detached from spring clip 90 by bending the clip away 128 from engagement with notch 88, and is rotated on axis 74 until end 130 extends into opening 132 in wall 134 of jamb 38. This rotates curved hook 100 out of opening 112 and vertical opening 104.

Shoe arm 70 hooks in opening 132 by the upward force of the shoe applied to shoe arm 70. Preferably opening 132 is used for hooking of arm 70 to the jamb. Hooking to the jamb of the arm rotated against the jamb can be to a protrusion on the jamb caught by the arm so long as the protrusion does not interfere with operational sliding of the shoe in the jamb for unlocked vertical movement of the sash.

Figure 14:
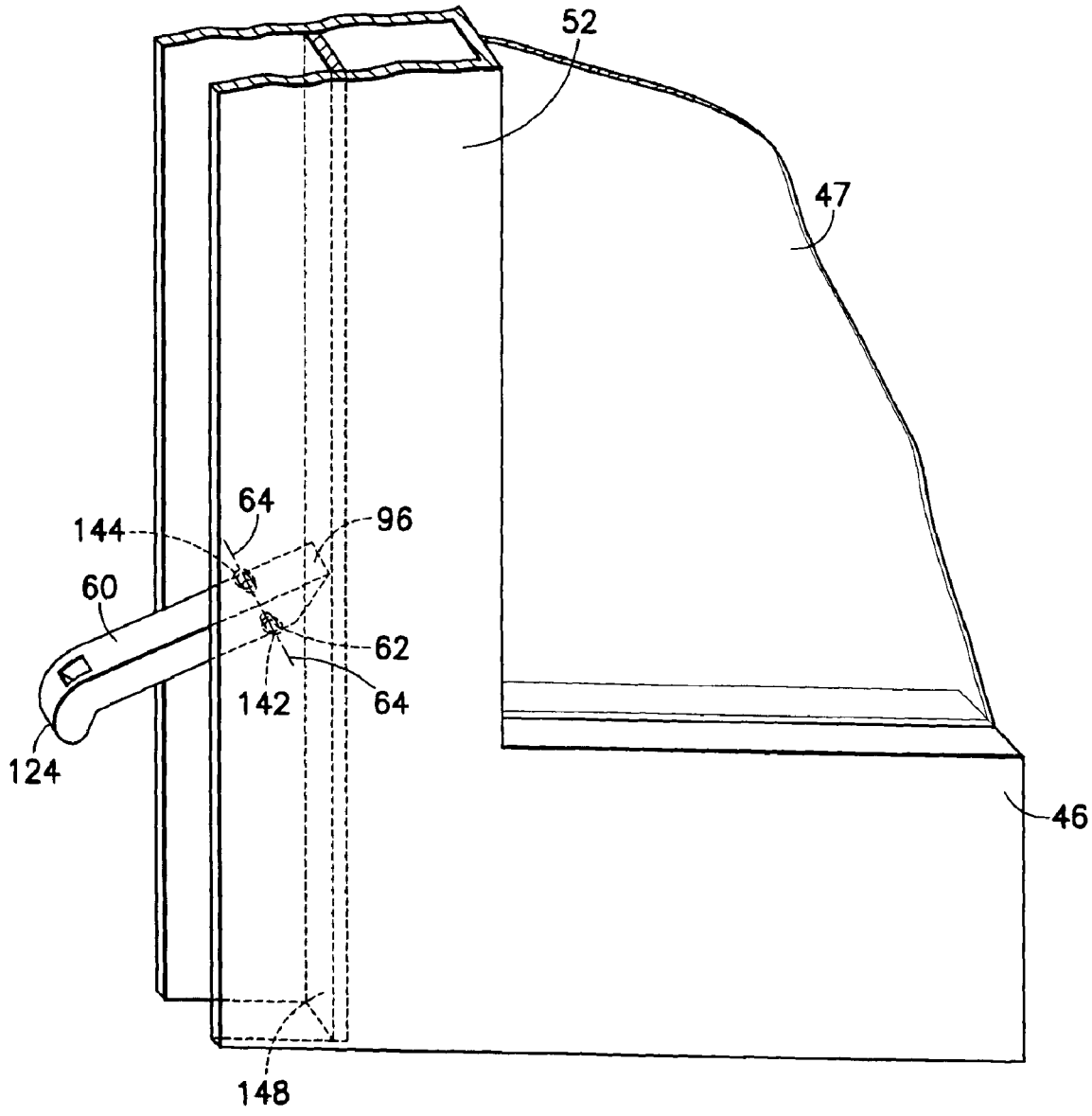
FIG. 14 is a right side perspective view of the sash support arm pivotally mounted on a sash on a pin through a portion of the sash.

In FIG. 14, arm 60 is mounted on pin 62 through holes 142, 144 in sash 46. Arm 60 rotation is limited by impingement of end 96 against wall 148 so that lift expressed on end 124 by platform 110 is transferred to sash 46 by way of arm 60 and pin 62.

Steps for installing the system and sash on a window jamb include:

1. Screw bracket 50 into side 136 of sash 46 at approximately the lowest part of the sash with arm 60 hanging down or vertically from pin 62.

2. Detach shoe arm 70 from clip 90. Preferably shoe arm 70 is shipped with shoe arm 70 locked in clip 90.

3. Mount the shoe 34 on jamb 38 with shoe arm 70 hanging down from pin 72.

4. Mount balance 40 on the jamb.

5. Crank the balance to load its internal spring.

6. Put rod 140 and cross pin 32 in hooks 36.

7. Slowly let the balance lift the shoe until end 130 of shoe arm 70 which is biased against wall 134 of the jamb by the rotational vector of weight of the shoe arm, catches in opening 132, hooking in the slot from the upward thrust of the shoe on the shoe arm.

8. Mount the sash on the jamb and bring the sash down until arm 60 sits on platform 110.

9. Push the sash down until shoe arm 70 end 130 can be moved out of opening 132.

10. Rotate shoe arm 70, moving curved hook 100 through openings 104 and 112 until shoe arm 70 snaps into clip 90 opening 94 by way of notch 88 and protrusion 92.

Steps for removing the sash from the window jamb include:

1. Move the sash down so that shoe arm 70 is lower than opening 132 in the jamb.

2. Release the shoe arm from clip 90 so that the shoe arm rotates under its own weight toward jamb wall 134 so that end 130 rests against the jamb wall and curved hook 100 moves down out of openings 112 and 104 which frees arm 60 from shoe 34.

3. Move the sash up until end 130 moves into opening 132 and hooks there by upward force of the shoe.

4. Remove the sash from the jamb.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

DRAWING DESIGNATORS (INFORMAL LIST)

30 assembly
32 cross pin
34 shoe
36 hooks, downward, U-shaped
38 jamb
40 spring balance
46 sash
47 glass
50 bracket
52 stile
54 screw
56 mounting hole
60 sash support arm
62 pin
64 axis
66 pivot hole
68 pivot hole
70 shoe arm
72 pin
74 axis
80 bearing, upward open, C-shaped
82 bearing, upward open, C-shaped
86 bearing, downward open, C-shaped
88 notch
90 clip, spring
92 protrusion
94 opening
96 end of arm 60
98 distance
100 curved hook
102 radius
104 opening
106 top
110 platform
112 opening
114 space
115 horizontally
116 space
117 downward
118 end
120 surface
121 surface
122 thickness
124 end
128 away
130 end
132 opening
134 wall of jamb
136 side
140 rod
142 hole
144 hole
148 wall

What is claimed is:

1. A lock shoe system comprising:

a window comprising a vertical jamb and a sash mounted in the window, a balance shoe mounted on the jamb for vertical movement on the jamb, a platform on said balance shoe configured for vertical support of an item on said platform when an item is on said platform, a bracket fixedly mounted on the sash, a first arm mounted on said bracket, rotating about a first axis, and transferring lift from a first end of said first arm to said bracket, said first end of said first arm being on said platform, a second arm mounted on said balance shoe for rotating about a second axis, a portion of said second arm spaced from said second axis comprising a second end hooking to said jamb at at least one height along the vertical height of said jamb when said second arm is at a first rotary position of said second arm, said portion comprising a third end extending through a first opening in said platform and through a second opening in said first arm when said second arm is at a second rotary position of said second arm.

2. The lock shoe system of claim 1 further comprising:

means on said second end for locking said third end in said second opening.

3. The lock shoe system of claim 1 further comprising:

said second axis is parallel to said first axis.

4. A lock shoe system comprising:

a window comprising a vertical jamb and a sash mounted in the window, a balance shoe mounted on the jamb for vertical movement on the jamb, a platform on said balance shoe configured for vertical support of an item on said platform when an item is on said platform, a first arm mounted on said balance shoe, rotating about a first axis, a portion of said first arm spaced from said first axis comprising a first end hooking to said jamb at at least one height along the vertical height of said jamb when said first arm is at a first rotary position of said first arm, said portion comprising a second end extending upward through a first vertical opening in said platform when said first arm is at a second rotary position of said first arm.

5. The lock shoe system of claim 4 further comprising:

means on said first end for locking said second end in said first opening.

6. A lock shoe system comprising:

a window comprising a vertical jamb and a sash mounted in the window, a balance shoe mounted on the jamb for vertical movement on the jamb, a platform on said balance shoe configured for vertical support of an item on said platform when an item is on said platform, a first arm, pivotally mounted on said sash, rotating about a first axis, and transferring lift from a first end of said first arm to said sash, said first end of said first arm being on said platform, a second arm mounted on said balance shoe for rotating about a second axis, a portion of said second arm spaced from said second axis comprising a second end hooking to said jamb at at least one height along the vertical height of said jamb when said second arm is at a first rotary position of said second arm, said portion comprising a third end extending through a first opening in said platform and into a second opening in said first arm when said second arm is at a second rotary position of said second arm.

7. A lock shoe system comprising:

a window comprising a vertical jamb and a sash mounted in the window, a balance shoe configured for mounting on the jamb for vertical movement of said balance shoe on the jamb, a platform on said balance shoe configured for vertical support of an item on said platform when an item is on said platform, a first arm, means on said first arm for mounting said first arm on a sash for transferring lift from said first arm to the sash when said first arm is mounted on the sash, a first end of said first arm being on said platform, a second arm mounted on said balance shoe, rotating about a first axis between a first position of said second arm and a second position of said second arm, a portion of said second arm spaced from said first axis comprising a second end hooking to the jamb at at least one height along the vertical height of the jamb when the second arm is at the first position, said second arm being at the second position, said portion comprising a third end extending through a first opening in said platform and into a second opening in said first arm.

* * * * *